US008512783B2

(12) United States Patent
Piccioli et al.

(10) Patent No.: US 8,512,783 B2
(45) Date of Patent: Aug. 20, 2013

(54) REDUCED PRESSURE LOSS PASTEURIZABLE CONTAINER AND METHOD OF MAKING THE SAME

(75) Inventors: David Piccioli, Auburn, NH (US); Amit Agrawal, Merrimack, NH (US); Ralph Armstrong, Weston, CT (US)

(73) Assignee: Graham Packaging Company LP, York, PA (US)

( * ) Notice: Subject to any disclaimer, the term of this patent is extended or adjusted under 35 U.S.C. 154(b) by 562 days.

(21) Appl. No.: 11/697,218

(22) Filed: Apr. 5, 2007

(65) Prior Publication Data

US 2008/0245761 A1 Oct. 9, 2008

(51) Int. Cl.
*B65D 90/02* (2006.01)

(52) U.S. Cl.
USPC ..... 426/407; 426/232; 426/397; 426/521

(58) Field of Classification Search
USPC ..... 426/407, 397, 232, 521
See application file for complete search history.

(56) References Cited

U.S. PATENT DOCUMENTS

| | | | | |
|---|---|---|---|---|
| 3,862,288 | A * | 1/1975 | Su | 264/235 |
| 4,693,902 | A * | 9/1987 | Richmond et al. | 426/407 |
| 2003/0186006 | A1* | 10/2003 | Schmidt et al. | 428/35.7 |
| 2004/0187444 | A1* | 9/2004 | Hutchinson et al. | 53/453 |
| 2007/0063394 | A1 | 3/2007 | Lepage | |

FOREIGN PATENT DOCUMENTS

WO WO 2005/102865 A 11/2005

OTHER PUBLICATIONS

International Search Report and Written Opinion in corresponding PCT/US2008/059255 dated Jul. 14, 2008.

* cited by examiner

*Primary Examiner* — Brent O'Hern
(74) *Attorney, Agent, or Firm* — Novak Druce Connolly Bove & Quigg LLP

(57) ABSTRACT

Containers for pressurized filling and pasteurization and methods of reducing creep in a pressurized pasteurizable container. The container is a blow-molded plastic container having a biaxially oriented wall of a structural polymer with a moisture content of no greater than a predetermined value at the start of a pressurized filling, capping, and pasteurization process. Also disclosed are pasteurizable containers having a desired shelf life.

21 Claims, 6 Drawing Sheets

REDUCED PRESSURE LOSS PASTEURIZABLE CONTAINER AND METHOD OF MAKING THE SAME

FIELD OF THE INVENTION

The present invention relates to pressurized plastic containers subject to pasteurization that exhibit reduced creep.

BACKGROUND OF THE INVENTION

Many products (e.g., food and beverages) undergo pasteurization in order to reduce the number of microorganisms in the product. The process involves heating a filled and sealed container at an elevated temperature for a time period sufficient to a pasteurize the contents. Desirably, the physical stability of the bottle and the biological stability and flavor of the contents are minimally compromised, thereby increasing the shelf life.

For example, there are various organisms in beer that, while not pathological or dangerous to humans, can affect the taste and appearance of the beer if allowed to grow. Draft beer does not require pasteurization because it is kept refrigerated and consumed in a short period of time. However, beer packaged in glass bottles or metal cans is traditionally pasteurized to achieve a long shelf life. In a conventional pasteurization process, known as tunnel pasteurization, water is sprayed onto a series of closely spaced packages as they move on a conveyor through a pasteurization tunnel, the tunnel being divided into a series of zones which may include preheating, heating, holding and cooling zones. The temperature of the beer in the containers is progressively raised to a desired level, held at this level for a predetermined period of time, and then cooled before exiting the tunnel. Generally, in order to insure complete pasteurization, the temperature of the beer at the "cold spot" (one quarter inch from the bottom of the center of the can or bottle) must reach a temperature of at least 140° F. for a sufficient period of time to produce a cumulative heating profile (e.g., a specified number of pasteurization units (P.U.), generally defined as the amount of heat imparted into the product during the elevated temperature and time period. Because the temperature of the beer generally increases when progressing from the cold spot to the top of the package, it is desirable to pasteurize at the lowest possible cold spot temperature (above 140° F.) to avoid overheating (and thus deforming or degrading) the rest of the product and package. One example of a tunnel pasteurization process is described for example in U.S. Pat. No. 4,693,902 to Richmond et al., the contents of which are hereby incorporated by reference in their entirety.

Although products such as beer have historically been pasteurized in glass bottles, it would be desirable to use plastic containers, e.g., containers comprising polyethylene terephthalate (PET) homopolymer or copolymers, to take advantage of PET's lighter weight and shatter resistance. However, producing a pasteurizable plastic beer container that can withstand the pasteurization time/temperature profile and provide a desired shelf life, at a price that is commercially viable, has been a long-standing need in the industry based on numerous problems which must be overcome. In particular, the range of temperatures encountered during pasteurization will cause a typical plastic container to undergo permanent, uncontrolled deformation (also known as creep).

Deformation is undesirable not only from an aesthetic perspective, but because it results in a loss of carbonation pressure. The volume growth undergone by a plastic container during pasteurization produces a drop in the product fill line, which increases the head space and results in a drop in carbonation ($CO_2$) pressure in the liquid. This drop in $CO_2$ pressure reduces the overall shelf life because the filled and pasteurized container is effectively starting with a reduced carbonation pressure. In various applications, it would be desirable to provide a pasteurizable beer container having an initial carbonation pressure of 3.3 volumes of $CO_2$ (where "volumes"=volume $CO_2$ per volume water) and a shelf life of 16 weeks.

Accordingly, there remains a need to provide pressurized plastic containers that can withstand pasteurization with reduced deformation.

SUMMARY OF THE INVENTION

One embodiment provides a method of reducing creep in a pressurized pasteurizable plastic container comprising:

providing a blow-molded plastic container, the container having a biaxially-oriented wall of a structural polymer with a moisture content of no greater than a predetermined value at the start of a pressurized filling, capping, and pasteurization process, wherein the structural polymer is present in an amount of 85% or greater by weight relative to the total weight of the container wall, and wherein the predetermined value is selected to reduce creep in the pressurized pasteurized container.

Another embodiment provides a pasteurizable plastic container comprising a blow-molded plastic container having a biaxially-oriented wall of a structural polymer with a moisture content of no greater than a predetermined value at the start of a pressurized filling, capping and pasteurization process, the predetermined value limiting pressure loss in the pasteurized container over a desired shelf life.

Another embodiment provides a method of making a pressurized pasteurizable plastic container having reduced creep comprising;

blow molding a plastic container having a biaxially-oriented wall;

subjecting the container to filling with a pressurized liquid, capping and pasteurization, wherein the biaxially-oriented wall has a moisture content of no greater than a predetermined value at the start of the filling step, the predetermined value being selected to limit pressure loss in the pressurized pasteurized container over a desired shelf life.

Another embodiment provides a method of making pasteurizable plastic containers having reduced creep comprising providing a substantially continuous in-line process of blow molding, filling, capping and pasteurization steps, including blow molding a plastic preform to form a blow-molded plastic container having a biaxially-oriented wall, conveying the blow-molded container to a filling and capping station at which the blow-molded container is filled with a pressurized liquid and capped, and conveying the filled and capped container to a pasteurization station for pasteurization, and wherein at the start of filling the container wall has a moisture content of no greater than a predetermined value selected to reduce creep of the pasteurized container.

DETAILED DESCRIPTION

According to one embodiment, a method is provided for reducing creep in a pressurized pasteurizable plastic container.

Figure 1:
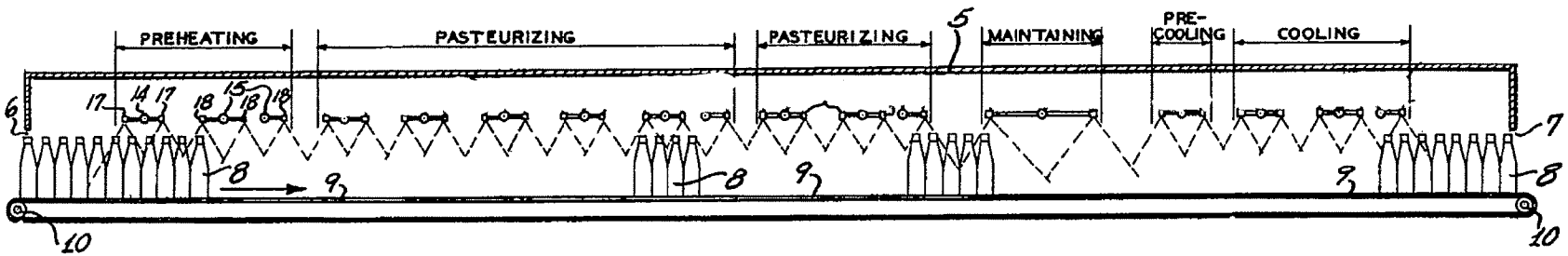
FIG. 1 is a schematic diagram of one example of a tunnel pasteurization method and apparatus.

FIG. 1 is an illustration of a suitable pasteurizing apparatus and method that may be used in the present invention. Commonly known as a tunnel pasteurizer, it comprises an elongated housing 5 having an entrance 6 and an outlet 7 at opposite ends of the housing. A conveyor is employed to transmit bottles 8 (or equivalent containers) containing liquids to be pasteurized from the entrance 6 to the outlet 7. An endless conveyor belt 9 is shown which travels around pulleys 10 at opposite ends of the apparatus. Above the bottles, a series of header pipes 14 and 15 are provided having nozzles 17 and 18 that release fluid in the form of a spray onto the bottles. As the bottles slowly progress from the entrance 6 to the outlet 7 they are successively subjected to sprays of liquid for preheating, pasteurizing, and cooling of the filled containers.

When entering the housing the relatively cool bottles may first be subjected to sprays of liquid (e.g., water) at a preheating temperature, such as 120° F., to preheat the bottles before they are subjected to a relatively hot spray. The containers pass under a series of nozzles in the preheating zone which spray the bottles with the liquid; the preheating liquid sprayed onto the bottles will fall by gravity into a lower compartment and is collected for reuse.

The bottles next pass through liquid sprays at a pasteurizing temperature which brings the bottles and their contents to a desired temperature and maintains the temperature to provide the desired pasteurizing action. The maximum temperature of the sprayed liquid may be 145° F., so as to achieve a maximum internal temperature at the cold spot of the container just slightly above 140° F. (e.g., 141° F.). Here, the tunnel pasteurizer includes two successive pasteurizing zones followed by a maintaining zone, each of which may subject the bottles to a liquid spray of a different temperature to achieve a desired temperature profile. This is by way of example only and not limiting. Again the pasteurizing fluid falls by gravity into the compartment below.

After the bottles pass from the pasteurizing and holding zone(s), they can first be precooled and then subjected to a more intense cooling action. The precooling liquid may be at a temperature of 125° F., followed by successive cooling sprays at for example 75° F. and 60° F. The bottles then exit the tunnel pasteurizer at a desired temperature.

The conveyer belt can have the design of U.S. Pat. No. 2,658,608, the disclosure of which is incorporated herein by reference. Alternatively, the method of conveyance can involve a walking beam as described in U.S. Pat. No. 4,441,406.

FIG. 1 illustrates one embodiment of a pasteurization system. However, it will be apparent to those skilled in the art that different forms of apparatus may be employed to carry out the pasteurization process, and the various parameters of the process (e.g., time and temperatures of the liquid sprayed on the containers) may be varied in accordance with the nature of the product to be treated and the results desired. For example, FIG. 1 depicts three heating and cooling zones, although any number of spray systems can be used as known in the art, e.g., more zones can be used and each zone can comprise one or more showers using any number of designs known in the art.

In one embodiment, the plastic container has a biaxially oriented wall of a structural polymer with a moisture content of no greater than a predetermined value at the start of a pressurized filling, capping and pasteurization process. In one embodiment, the structural polymer is present in an amount of 85% or greater by weight relative to the total weight of the container wall.

The structural polymer can comprise those materials well known in the art. In one embodiment, the structural polymer is a polyester, such as polyethylene terephthalate homopolymers, copolymers, and blends thereof.

Figure 2:
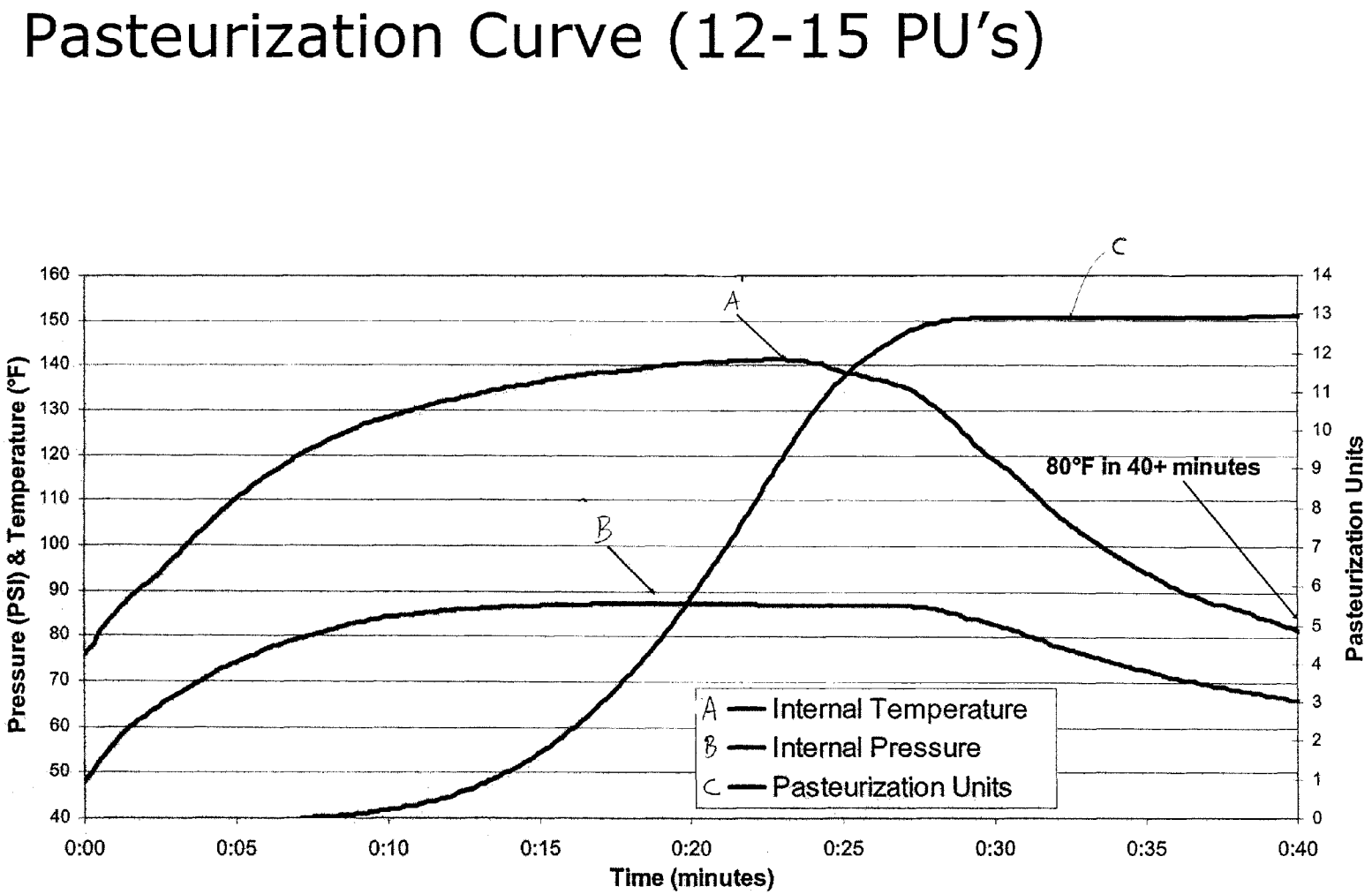
FIG. 2 is an example of a pasteurization profile curve showing the internal temperature (curve A), pressure (curve B), and pasteurization units (curve C) over the time of pasteurization (minutes)

FIG. 2 illustrates one example of a time/temperature profile for pasteurizing beer in plastic containers. Use of this process on an exemplary container will be described below according to one embodiment of the invention. FIG. 2 is a graph of internal bottle pressure (psi) and internal bottle temperature (° F.), each graphed on the vertical axis, as a function of time (minutes) during the pasteurization cycle. Curve A shows the temperature profile and curve B shows the pressure profile inside the container during pasteurization. For this particular example, the maximum internal temperature of the liquid is 141.3° F. (Curve A) and the maximum internal pressure is 87.3 psi (Curve B). FIG. 2 also includes a third curve C showing the pasteurization units (P.U.s) as a function of time according to a scale on the right-hand side of the graph. P.U. per minute is a rate term which is exponential with temperature:

$$PU/\text{minute}=10^{[(T-140)/12.5]}$$

One P.U. for beer is 1 minute at 140° F. PU begins to become significant when the beer temperature is above about 130-135° F., and most significant at 139° F. and above. However, P.U. accumulation begins at 120° F. Again, this pasteurization curve for a desired P.U. range of 12-15 is meant to be illustrative only and is not limiting. Different manufacturers will have different requirements for pasteurizing beer or other beverages (such as juice or soda), e.g., a minimum P.U. of 10, or a minimum P.U. of 8, and thus the process parameters will vary for the desired application.

Figure 3:
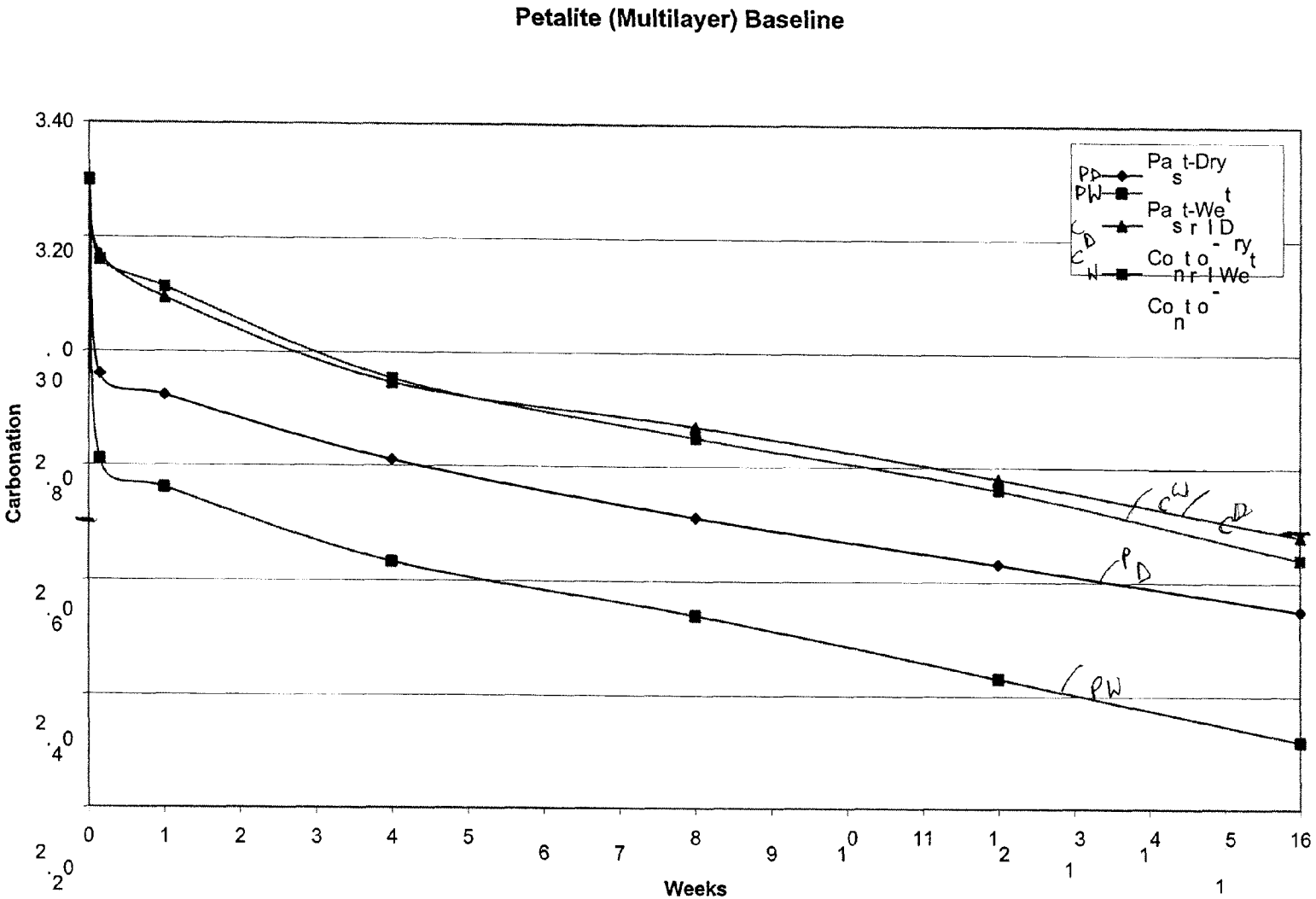
FIG. 3 is a graph showing one example of the effect of moisture on the loss of carbonation (volumes of $CO_2$) versus time (weeks) for a 16 ounce multilayer beer bottle.

In one embodiment, the desired shelf time for the pasteurized contents, e.g., beer, is at least 12 weeks, and in a further embodiment, at least 16 weeks. FIG. 3 is a graph of carbonation loss (volumes of $CO_2$) versus time (weeks) for a 16 ounce multilayer beer bottle subjected to a simulated 16 week shelf life test. This 16 week test (the results of which are graphed in FIG. 3) involves storing bottles at 72° F. and 50% relative humidity for the duration of the test. Periodically, the bottles are tested for headspace and pressure and displacement volume. The headspace pressure along with the temperature of a representative "temperature bottle" (stored in the same conditions) are used to calculate the carbonation level in the package. In one embodiment, shelf life is assessed by the amount of volume loss of $CO_2$ in the container.

The top two curves of FIG. 3, control-dry (CD) and control-wet (CW), illustrate that for a container that has not undergone pasteurization, the initial carbonation pressure of 3.3 volumes of $CO_2$ (immediately after filling and capping) will fall off over time at substantially the same rate. There is an initial relatively steep drop off in the first day, and then a more gradual substantially linear carbonation loss over 16 weeks to a final level of about 2.7 volumes of $CO_2$. However, if these same containers are pasteurized, there is a considerable difference in performance of the dry container (dry structural polymer, PD) versus the wet container (wet structural polymer, PW). The lowermost curve (PW) illustrates what happens when moisture absorption of the blow molded container is not controlled and the bottle is then filled, capped and pasteurized. There is a very steep drop off from 3.3 to 2.8 volumes over the first day, followed by a steady more gradual decline over the desired 12-16 week shelf life, to a final carbonation pressure of about 2.3 volumes. This amount of carbonation loss is unacceptable for many commercial applications, and thus the desired 16 week shelf life is not achieved. However, it has been found that if the moisture content of the container is controlled such that at the start of filling the moisture content is no greater than a predetermined amount, then the container can be pasteurized with a much lower initial drop of carbonation loss, followed by a gradual decrease of carbonation loss which is acceptable over the 16 week period. As shown in the PD curve (dry container) of FIG. 3, greater than 50% of the carbonation loss has been effectively eliminated.

Accordingly, in one embodiment, one parameter, namely the moisture content of the structural polymer in the container prior to the pasteurization process, can have an effect on the volume change (and resulting carbonation loss) undergone by the pasteurized container. In prior processes, the initial moisture content of the container was not controlled and the carbonation loss during pasteurization and subsequent storage (prior to use) could be unacceptably high. In one embodiment, container deformation can be reduced by controlling the moisture content, resulting in reduction of carbonation loss.

Figure 4:
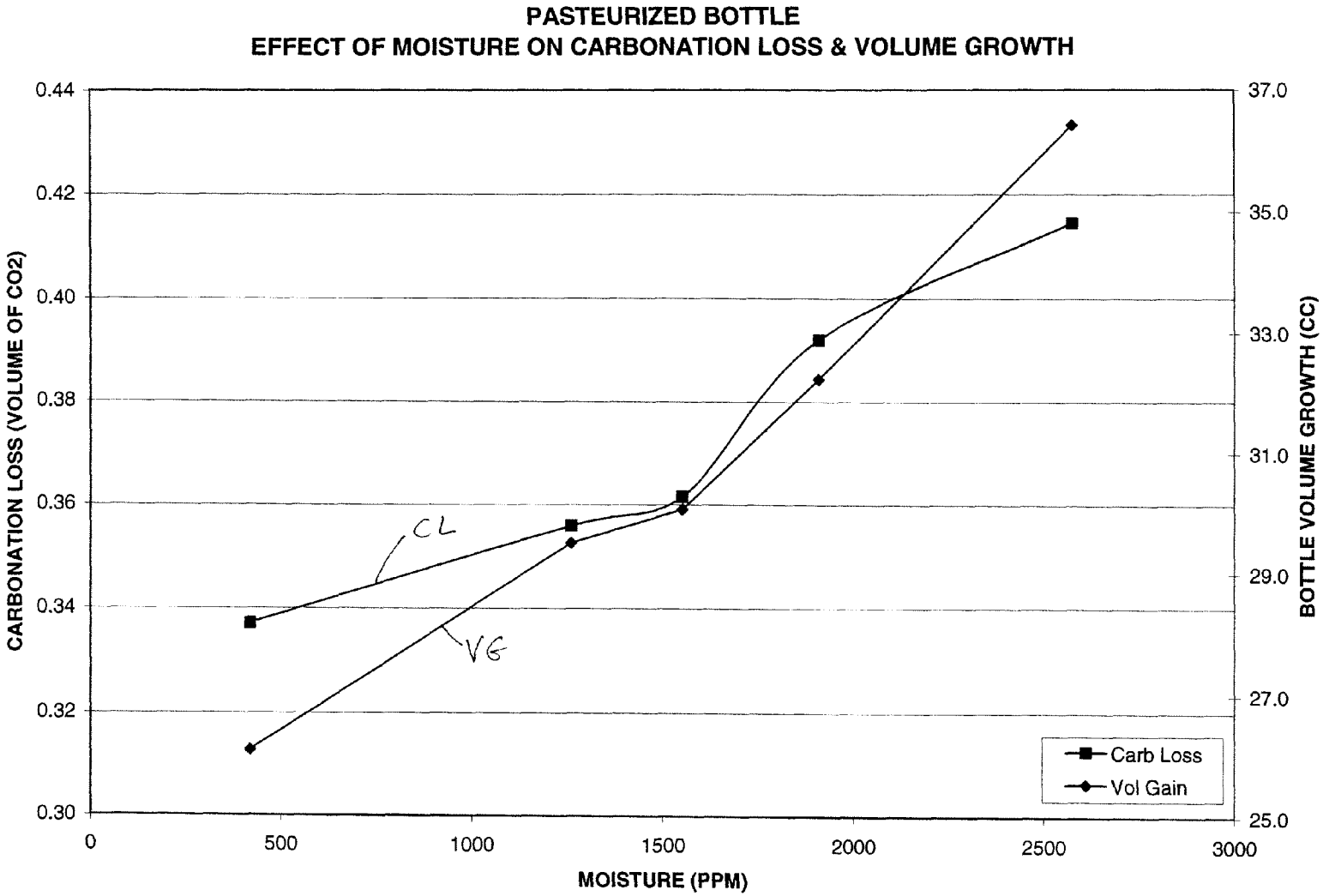
FIG. 4 is a graph showing the relationship between carbonation loss (CL curve, volumes $CO_2$) and volume growth (VG curve, cc) for one bottle, which has undergone pasteurization, as a function of moisture content (ppm)

FIG. 4 is a graph indicating the relationship between carbonation loss (CL curve, volumes $CO_2$) and volume growth (VG curve, cc) of a bottle after being subjected to pasteurization as a function of initial moisture content (ppm, prior to pasteurization) of the structural polymer. If the moisture content of the structural layer in the bottle is increased, the volume growth of the bottle shows a general corresponding increase. Consequently the amount of carbonation loss (volumes of $CO_2$) also increases.

Methods for measuring moisture content are well known in the art. In one embodiment, moisture content is determined by a Karl Fischer titration with a reagent containing iodine and sulfur dioxide. During the titration, the iodine reacts with water until the water in the sample is completely consumed. Based on the amount of reagent needed to consume the water, the moisture content is calculated. An exemplary instrument for performing a Karl Fischer titration is an Aquastar® AQ-2000.

In one embodiment, the amount of moisture present in the structural polymer prior to filling is less than 5000 ppm, such as an amount of less than 3000 ppm, independent of bottle size. Typically a blow molded bottle pick up moisture while in storage. According to one embodiment of the invention, for example, a 500 mL bottle contains 750 ppm moisture in the structural polymer immediately after it is blow molded. In another embodiment, the moisture content is less than 1500 ppm, less than 1000 ppm, or even less than 500 ppm. In yet another embodiment, the moisture content ranges from 500-1500 ppm. In yet another embodiment, the moisture content is approximately 0 ppm.

In one embodiment, the container is filled with a pressurized liquid having an initial carbonation of 2.5 to 3.7 volumes of $CO_2$, such as an initial carbonation of 2.7 to 3.5 volumes of $CO_2$, or an initial carbonation of 3 to 3.4 volumes of $CO_2$.

In one embodiment, the wall of the container is a biaxially-oriented sidewall adapted to be filled at 3.3 volumes of $CO_2$.

In one embodiment, the pasteurization process produces at least 7 pasteurization units (P.U.), such as from 7-30 P.U.'s, from 7-15 P.U.'s, or from 7-12 P.U.'s. In another embodiment, the pasteurization process produces at least 10 pasteurization units (P.U.).

In one embodiment, the amount of $CO_2$ loss due to the reduction in moisture content of the structural polymer is 0.5 volumes $CO_2$ or less, such as an amount of 0.4 volumes $CO_2$ or less (from a starting amount of 3.3 volumes).

For example, filling and capping a container provides approximately 3.3 $CO_2$ volumes. After subjecting the filled container to pasteurization, in one embodiment, it is desired that the bottle contain at least 3.0 volumes of $CO_2$, e.g., a loss of 0.3 volumes. In one embodiment, the structural polymer has an initial moisture level (prior to pasteurization) of 2000 ppm or less, resulting in a loss of 0.4 volumes or less of $CO_2$ (3.3 volumes $CO_2$ before pasteurization to 2.9 volumes $CO_2$ after pasteurization). For example, in a 500 mL bottle, the resulting volume growth would be 34 mL or less. In another embodiment, the structural polymer has an initial moisture level of 1500 ppm or less, resulting in a loss of 0.36 volumes or less of $CO_2$ after pasteurization (e.g., a volume growth of 31 mL or less for a 500 mL bottle). In yet another embodiment, the structural polymer has a moisture content of 1000 ppm or less, resulting in loss of 0.34 volumes or less of $CO_2$ after pasteurization (e.g., a volume growth of 28 mL or less for a 500 mL bottle).

The container can be made of structural polymer only or can include a layer of a non-structural polymer, e.g., a nylon such as MXD6. Generally, the structural polymer comprises the largest weight percent, e.g., 85% or more. In the case of multi-layer bottles containing non-structural polymers, generally the moisture content of the structural polymer has a predominant effect on the amount of volume growth of the bottle, e.g., nylons such as MXD6 may contain a larger amount of water relative to the amount in the structural polymer, but the nylon is a much lower weight percentage and does not substantially affect the creep.

Another embodiment provides a pasteurizable plastic container comprising a blow-molded plastic container having a biaxially-oriented wall with a moisture content of no greater than a predetermined value at the start of a pressurized filling, capping and pasteurization process, the predetermined value limiting pressure loss in the pasteurized container over a desired shelf life. In one embodiment, the container comprises a structural polymer in the amount of 85% or greater relative to the total weight of the container.

Figure 5:
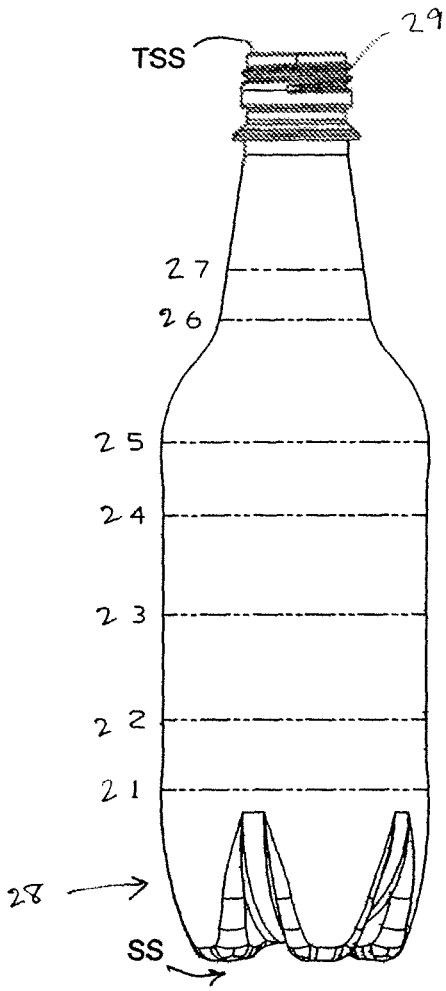
FIG. 5 is a perspective view of one embodiment of a single serve pasteurizable PET container.

FIG. 5 illustrates the container used in the present embodiment. It is a single serve 16-ounce PET container of 35 grams. The container includes a top sealing surface (TSS), a threaded neck finish 29 above a tamper proof closure ring and capping flange, a relatively long and narrow neck 27, a shoulder 26, an upper bumper 25, an upper panel 24, a mid panel 23, a lower panel 22, a lower bumper 21, and a substantially full hemisphere 5-footed base 28. The container rests on a standing surface (SS) formed by the lowermost surfaces of the five feet. The neck finish is 28 mm in diameter, having a thick E-wall of 0.080 inches.

Exemplary wall thicknesses of the container of FIG. 5 the finish are described by position numbers in Table 1, corresponding to the lines drawn through the respective sections in FIG. 5. The bottle has been blow molded from a preform made of Wellman 61804 PET resin having an intrinsic viscosity of 0.80 g/mL prior to molding. The bottle is multilayer, including two internal layers of an oxygen-scavenging composition which reduces the ingress of oxygen into the container. In this example, the scavenging composition layers comprise 5 weight percent of the container; the specific scavenger used is described in U.S. Published Application No. 2002/0037377. The container is capped by a closure having an NCC plug seal (non-barrier) for 28 mm finishes.

TABLE 1

Wall Thickness

| POSITION # | LOCATION | WALL THICKNESS (Mils × 1000) |
|---|---|---|
| 21 | Lower Bumper | 16.4 |
| 22 | Lower Panel | 15.2 |
| 23 | Mid Panel | 15.9 |
| 24 | Upper Panel | 15.2 |
| 25 | Upper Bumper | 14.2 |
| 26 | Shoulder | 22.6 |
| 27 | Neck | 23.5 |

A process according to one embodiment will now be described for providing a pasteurizable container having a desired shelf life (reduced deformation and/or reduced carbonation loss), as illustrated by the results disclosed herein. However, there are other methods which can be used to obtain the desired moisture level, and this is just one example.

Figure 6:
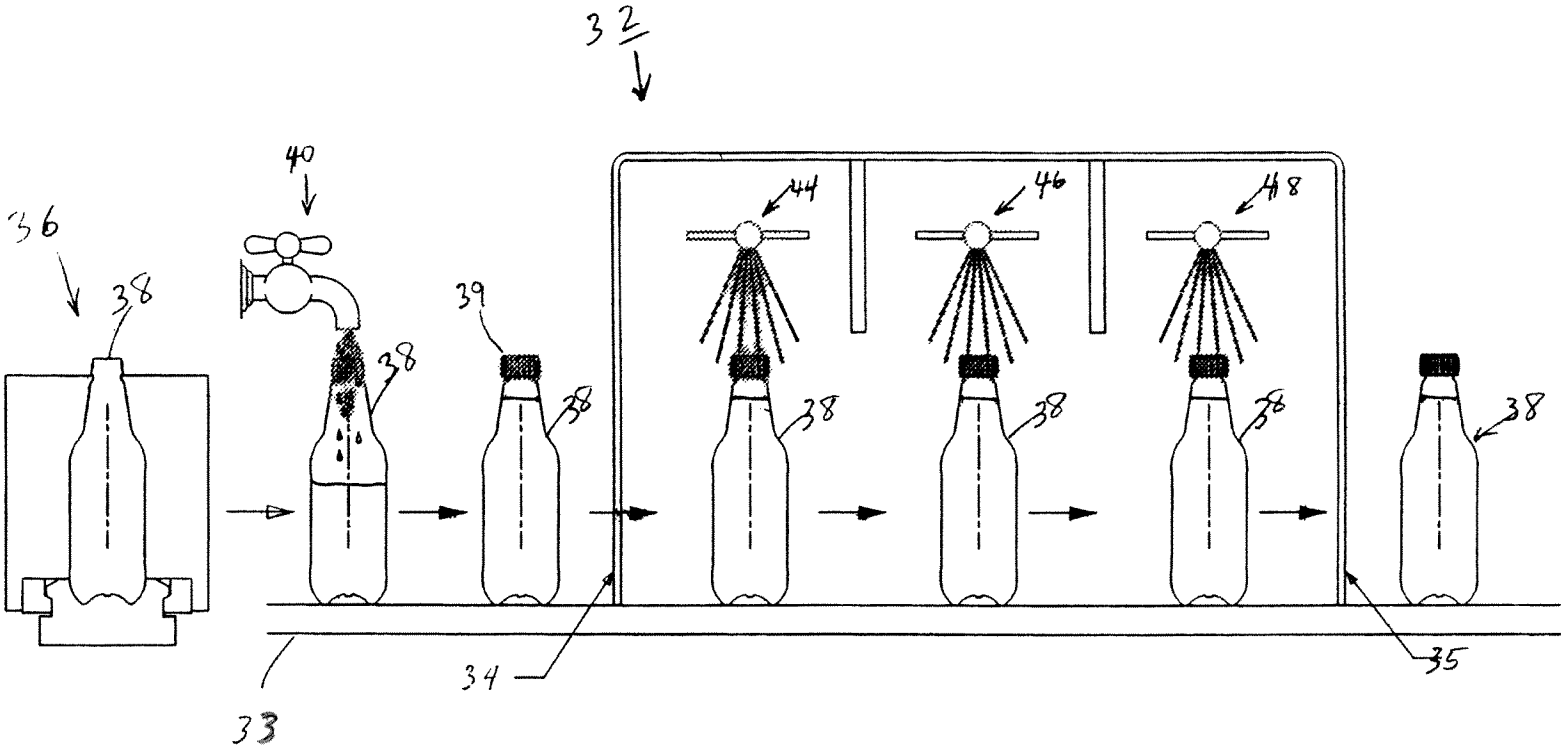
FIG. 6 is a schematic of an in-line system for manufacturing, filling and capping, and pasteurizing a plastic bottle, according to one embodiment of the invention.

One embodiment provides an "in-line process" for controlling the moisture content of the blow-molded containers. FIG. 6 illustrates this in-line process which includes, in serial order:

blow molding
filling
capping
pasteurization (including heating, holding and cooling zones), followed by emergence of the pasteurized containers.

In FIG. 6, container 38 is manufactured in blow mold 36 and filled with the contents to be pasteurized followed by sealing with a closure 39 at zone 40. The initial carbonation pressure immediately after capping is 3.3 volumes of $CO_2$. The conveyer belt 33 brings the filled and sealed container 38 to the pasteurization tunnel 32 through tunnel entrance 34. In tunnel 32, various heating and cooling zones progressively raise and subsequently lower the temperature of the sealed container. These zones comprise a series of showers each having a predetermined temperature. In tunnel 32, container 38 is first wetted by a first set of showers in zone 44 to gradually increase the temperature of container 38 and its contents. FIG. 6 schematically shows only one set of showers in zone 44 although the number can vary to two or more depending on the temperature increase and the desired rate of increase. Subsequently, showers in zone 46 maintain the contents of bottle 38 at the pasteurization temperature, e.g., 140° F. for beer. The container 38 is then conveyed to zone 48 where showers cool bottle 38 down to ambient temperatures. The precooling liquid may be at a temperature of 125° F., optionally followed by successive cooling sprays at for example 75° F. and 60° F. Bottle 38 emerges from the pasteurization tunnel 32 through exit 35 at a desired temperature with the pasteurized product ready for labeling and distribution.

A conveyor belt 33 conveys a series of containers through the various blow molding, filling, capping, heating and cooling zones. In actual practice, the containers would be stacked on the conveyor in a continuous series in direct contact with adjacent containers. The schematic of FIG. 6 is for ease of illustration and understanding of the present in-line process.

In another embodiment, the container is blow molded and stored under dry conditions to maintain a predetermined moisture content level, e.g., less than 2000 ppm.

Another embodiment provides a method of making a pressurized pasteurizable plastic container having reduced creep comprising;

blow molding a plastic container having a biaxially-oriented wall;

subjecting the container to filling with a pressurized liquid, capping and pasteurization, wherein the biaxially-oriented wall has a moisture content of no greater than a predetermined value at the start of the filling step, the predetermined value being selected to limit pressure loss in the pressurized pasteurized container over a desired shelf life. In one embodiment, the method is performed in-line. In another embodiment, the container comprises a structural polymer in the amount of 85% or greater relative to the total weight of the container.

Another embodiment provides a method of making pasteurizable plastic containers having reduced creep comprising providing a substantially continuous in-line process of blow molding, filling, capping and pasteurization steps, including blow molding a plastic preform to form a blow-molded plastic container having a biaxially-oriented wall, conveying the blow-molded container to a filling and capping station at which the blow-molded container is filled with a pressurized liquid and capped, and conveying the filled and capped container to a pasteurization station for pasteurization, and wherein at the start of filling the container wall has a moisture content of no greater than a predetermined value selected to reduce creep of the pasteurized container. The filled container is then immediately subjected to pasteurization, i.e., before the structural polymer has a moisture level greater than 2000 ppm.

Table 2 specifies the pasteurization parameters used in an example of an in-line process.

TABLE 2

Pasteurization conditions

| ZONE | LENGTH (IN.) | CATEGORY | TYPICAL SPRAY TEMPERATURE |
|---|---|---|---|
| 1 | 6 | Preheat | 125° F. (52° C.) |
| 2 | 24 | Heat | 144° F. (62° C.) |
| 3 | 10.5 | Hold | 144° F. (62° C.) |
| 4 | 13.5 | Hold | 144° F. (62° C.) |
| 5 | 6 | Cool | 125° F. (52° C.) |
| 6 | 12 | Cool | 75° F. (24° C.) |
| 7 | 12 | Cool | 58° F. (15° C.) |

Due to the range of temperatures experienced by the container during pasteurization (e.g., from room temperature to at least 140° F.), the plastic container can experience deformations in one or more of the neck finish, shoulder, panel and base areas. During the heating phase of pasteurization, the product and head space gas expand in the sealed container. For example, when a container is filled with beer, the pressure can increase from e.g., 15 psi while cold (if the container is cold filled with beer) to approximately 45 psi at ambient temperature, and can peak at approximately 85 psi at a pasteurization temperature of 140° F. At these higher pressures and temperatures, one or more areas of the bottle may increase in diameter and/or height.

Table 3 lists the diameter changes in various portions of the container. It compares the amount of change along the various positions (21-27) for containers having different moisture contents, namely 700 ppm ("Dry"), 3,000 ppm, and 5,000 ppm as measured in a biaxially-oriented sidewall portion taken at location 23 (mid panel). The container having the lowest moisture content (700 ppm) had the lowest diameter changes in all of the various positions indicated. The container with the next greater moisture content (3000 ppm) had greater volume increases at each position, and the container having the greatest moisture content (5000 ppm) had yet greater increases in diameter at the various positions. Table 3 also specifies the wall thickness of the various positions. The greatest change in diameter occurred in the panel area, which is the thinnest wall portion of the container.

TABLE 3

| Diameter Change | | | | | | | | |
|---|---|---|---|---|---|---|---|---|
| # | LOCATION | DRY (700 PPM) | | 3000 PPM | | 5000 PPM | | Wall Thickness (mils × 1000) |
| 21 | Lower Bumper | 0.039 | 1.5% | 0.047 | 1.8% | 0.050 | 1.9% | 16.4 |
| 22 | Lower Panel | 0.070 | 2.7% | 0.084 | 3.2% | 0.100 | 3.8% | 15.2 |
| 23 | Mid Panel | 0.062 | 2.4% | 0.080 | 3.1% | 0.098 | 3.8% | 15.9 |
| 24 | Upper Panel | 0.069 | 2.7% | 0.092 | 3.5% | 0.100 | 3.9% | 15.2 |
| 25 | Upper Bumper | 0.038 | 1.5% | 0.049 | 1.8% | 0.053 | 2.0% | 14.2 |
| 26 | Shoulder | −0.008 | −0.5% | 0.013 | 0.8% | 0.049 | 3.2% | 22.6 |
| | Base Clearance | 0.003 | 1.0% | −0.022 | −8.3% | 0.038 | −14.4% | |

Table 3 also lists changes in base clearance for the three containers. The low moisture level (700 ppm) container had only a 1% change in base clearance, and it was a positive increase in base clearance. A reduction in base clearance is undesirable because at some point the hemispherical dome will extend down below the feet and the bottle will become unstable (a rocker). The 3,000 ppm container had a loss of base clearance of 8.3%. The 5,000 ppm container had an even more drastic loss of base clearance of 14.4%. Thus, the lower moisture content container had greater resistance to deformation in the base, as well as in the side wall.

Table 4 lists the height changes for the three containers, and is broken down by position and overall height change. Again, the height change in the dry (700 ppm) container was the lowest. The 3,000 ppm container had twice the overall height change of the dry container, and the 5,000 ppm container had four times the overall height change of the dry container. There was significant height change in each of the base, shoulder and neck areas of the higher moisture level containers.

TABLE 4

| Height Change | | | | | | | |
|---|---|---|---|---|---|---|---|
| # | LOCATION | DRY (700 PPM) | | 3000 PPM | | 5000 PPM | |
| SS-1 | Base | 0.004 | 0.2% | 0.005 | 0.3% | 0.015 | 0.9% |
| 21-22 | Lower Bumper | −0.002 | −0.3% | 0.004 | 0.5% | 0.000 | 0.0% |
| 22-23 | Lower Panel | −0.006 | −0.6% | −0.004 | −0.4% | 0.002 | 0.2% |
| 23-24 | Upper Panel | 0.005 | 0.5% | −0.004 | −0.4% | 0.010 | 1.0% |
| 24-25 | Upper Bumper | −0.002 | −0.3% | 0.006 | 0.8% | −0.011 | −1.6% |
| 25-27 | Shoulder | 0.006 | 0.3% | 0.008 | 0.5% | 0.014 | 0.8% |
| 27-TSS | Neck | 0.007 | 0.3% | 0.004 | 0.2% | 0.010 | 0.5% |
| SS-TSS | Overall | 0.012 | 0.1% | 0.019 | 0.2% | 0.041 | 0.4% |

Table 5 illustrates the carbonation loss which resulted from the volume growth (deformation) in the three containers. The dry container had a volume growth of 21.4 cc (4.1% of the overall container volume as blow-molded). The resulting carbonation loss was 0.34 volumes of $CO_2$ (10.2% of the initial carbonation of 3.3 volumes of $CO_2$). In contrast, the 3,000 ppm bottle had a volume growth of 29.0 cc (5.5%) and a carbonation loss of 0.43 volumes (12.7%). The 5,000 ppm container had a still greater volume growth of 33.5 cc (6.4%), and a resulting carbonation loss of 0.44 volumes (13.2%). Thus, controlling the moisture content of the container (as measured in the relatively thinnest biaxially-oriented panel section) resulted in a substantial improvement in reduced deformation and reduced carbonation loss. This example demonstrates that these changes can enable an extension of the shelf life and/or an improved performance over a designated shelf life.

TABLE 5

| Carbonation Loss | | | | | | |
|---|---|---|---|---|---|---|
| | DRY | | 3000 PPM | | 5000 PPM | |
| Volume Growth (CC) | 21.4 | 4.1% | 29.0 | 5.5% | 33.5 | 6.4% |
| Carbonation Loss (volumes of $CO_2$) | 0.34 | 10.2% | 0.43 | 12.7% | 0.44 | 13.2% |

These and other modifications will be readily apparent to the skilled person and are included within the scope of the claimed invention.

The invention claimed is:

1. A method of reducing creep in a pressurized pasteurizable plastic container comprising:

providing a blow-molded plastic container, the container having a biaxially-oriented wall of a structural polymer, controlling a moisture content of the container to a predetermined value of 2000 ppm or less at the start of a pressurized filling, capping, and pasteurization process, the pasteurization process comprising spraying the container with a heated liquid haying a spraying temperature up to 145° F., wherein the structural polymer is present in an amount of 85% or greater by weight relative to the total weight of the container wall, and wherein the predetermined value is selected to reduce creep in the pressurized pasteurized container.

2. The method of claim 1, wherein the structural polymer is a polyester material.

3. The method of claim 2, wherein the structural polymer is selected from polyethylene terephthalate homopolymers, copolymers, and blends thereof.

4. The method of claim 1, wherein the container has a moisture content of 1500 ppm or less.

5. The method of claim 1, wherein the container has a moisture content of 1000 ppm or less.

6. The method of claim 1, wherein the wall is a biaxially-oriented sidewall of a beverage container adapted to be filled at 3.3 volumes of $CO_2$.

7. The method of claim 1, wherein the container is filled with a pressurized liquid having an initial carbonation of 2.5 to 3.7 volumes $CO_2$.

8. The method of claim 1, wherein the container is filled with a pressurized liquid having an initial carbonation of 2.7 to 3.5 volumes $CO_2$.

9. The method of claim 1, wherein the container is filled with a pressurized liquid having an initial carbonation of 3 to 3.4 volumes $CO_2$.

10. The method of claim 1, wherein the pasteurization process produces at least 7 pasteurization units (P.U.).

11. The method of claim 1, wherein the pasteurization process produces from 7-30 pasteurization units (P.U.).

12. The method of claim 1, wherein the pasteurization process produces from 7-15 pasteurization units (P.U.).

13. The method of claim 1, wherein the pasteurization process produces from 7-12 pasteurization units (P.U.).

14. The method of claim 1, wherein the pasteurization process produces at least 10 pasteurization units (P.U.).

15. The method of claim 1, wherein the method comprises a substantially continuous in-line process of blow molding, pressurized filling, capping and pasteurization steps.

16. The method of claim 1, wherein after the container is filled with a pressurized liquid having 3.3 volumes $CO_2$, the container has a shelf life of at least 12 weeks.

17. The method of claim 1, wherein the container has a maximum volume increase of 7% over the course of the pasteurization process.

18. The method of claim 1, wherein the container has a maximum volume increase of 5% over the course of the pasteurization process.

19. The method of claim 1, wherein the container has a carbonation loss of no greater than 0.5 volumes $CO_2$ over the course of the pasteurization process.

20. The method of claim 1, wherein the container has a carbonation loss of no greater than 0.4 volumes $CO_2$ over the course of the pasteurization process.

21. The method of claim 1, wherein prior to filling, the bottle has been stored under dry conditions to maintain the moisture content at a level of no more than 2000 ppm.

* * * * *